US009259066B2

(12) United States Patent
Pratt

(10) Patent No.: US 9,259,066 B2
(45) Date of Patent: Feb. 16, 2016

(54) FOLDABLE EASY-ACCESS BAG

(76) Inventor: Michael James Pratt, Draper, UT (US)

( * ) Notice: Subject to any disclaimer, the term of this patent is extended or adjusted under 35 U.S.C. 154(b) by 0 days.

(21) Appl. No.: 13/270,428

(22) Filed: Oct. 11, 2011

(65) Prior Publication Data

US 2013/0087424 A1 Apr. 11, 2013

(51) Int. Cl.

| | |
|---|---|
| ***A45C 3/02*** | (2006.01) |
| ***A45C 3/00*** | (2006.01) |
| ***A45C 13/04*** | (2006.01) |
| ***A45C 7/00*** | (2006.01) |

(52) U.S. Cl.

CPC ..... *A45C 3/00* (2013.01); *A45C 7/0077* (2013.01); *A45C 13/04* (2013.01); *A45C 2003/008* (2013.01)

(58) Field of Classification Search

CPC ..... A45C 3/02; A45C 7/02; A45C 13/04; A45C 2003/005; A45C 7/0077; A45C 2003/008

USPC ..... 190/103, 105, 107, 122, 126, 127, 903, 190/24; 383/2, 33; 220/9.1, 9.2, 9.3; 135/102, 126

See application file for complete search history.

(56) References Cited

U.S. PATENT DOCUMENTS

| | | | | | |
|---|---|---|---|---|---|
| 2,014,904 | A | * | 9/1935 | Martin | 220/9.3 |
| 2,507,249 | A | * | 5/1950 | Dorazio | 206/315.8 |
| 2,899,161 | A | * | 8/1959 | Bayard | 248/101 |
| 3,564,586 | A | * | 2/1971 | Legoff | 206/315.8 |
| 4,383,142 | A | * | 5/1983 | Kaneko | 190/126 |
| 4,548,372 | A | * | 10/1985 | Lutzker | 248/99 |
| 4,610,334 | A | | 9/1986 | Pelavin | |
| 4,646,802 | A | * | 3/1987 | Basore et al. | 220/9.4 |
| 4,723,371 | A | * | 2/1988 | Williams | 43/1 |
| 4,895,230 | A | | 1/1990 | King | |
| 5,178,273 | A | * | 1/1993 | Igarashi | 206/315.7 |
| 5,273,142 | A | * | 12/1993 | Weber | 190/107 |
| 5,476,184 | A | | 12/1995 | Hill | |
| 5,620,069 | A | | 4/1997 | Hurwitz | |
| 5,638,954 | A | * | 6/1997 | Hsien | 206/315.8 |

(Continued)

FOREIGN PATENT DOCUMENTS

| | | | |
|---|---|---|---|
| GB | 2370601 | A * | 7/2002 |
| GB | 2445354 | | 7/2008 |
| WO | 2010081169 | | 7/2010 |

OTHER PUBLICATIONS

Excerpt from http://www.columbia.com/The-Mobex-%7C-Product-Spotlight/Pinnacle_Product-Mobex,default,pg.html accessed 11/28/20141.

*Primary Examiner* — Sue A Weaver

(74) *Attorney, Agent, or Firm* — Michael F. Krieger; Kirton McConkie

(57) ABSTRACT

Soft sided bags having a flexible frame system are disclosed and described herein. A plurality of structure forming frame members engage guides in the bag body to provide the soft sided bag with a resilient structure, and to further provide content protection and accessibility. Soft sided bag may use structure forming frame members with varying levels of stiffness to provide a desired structure to the soft sided bag. A unique structure forming frame member is disclosed which includes an outer sheath and inner rod that gives the bag body structure, durability, flexibility, resiliency, and differing degrees of restorative force along one continuous member. Various non-limiting configurations are disclosed that provide the soft sided bag with a desired shape as well as the ability to collapse to smaller configurations.

30 Claims, 8 Drawing Sheets

(56) References Cited

U.S. PATENT DOCUMENTS

| | | | | |
|---|---|---|---|---|
| 5,667,066 | A * | 9/1997 | Simpson | 206/278 |
| 5,845,697 | A * | 12/1998 | Zheng | 160/370.21 |
| 6,092,544 | A * | 7/2000 | Zheng | 135/125 |
| 6,702,119 | B2 * | 3/2004 | Sabounjian | 206/577 |
| 6,772,883 | B2 * | 8/2004 | Lindamood | 206/320 |
| 6,830,170 | B2 | 12/2004 | Abel | |
| 7,066,647 | B2 | 6/2006 | Peska | |
| 7,308,989 | B2 * | 12/2007 | Zheng | 220/9.2 |
| 7,353,963 | B1 * | 4/2008 | Sabounjian | 220/9.4 |
| 7,614,517 | B2 * | 11/2009 | Zheng | 220/9.2 |
| 7,699,186 | B2 * | 4/2010 | Zheng | 220/565 |
| 7,815,372 | B2 * | 10/2010 | Stanton et al. | 383/104 |
| 7,921,863 | B2 * | 4/2011 | Ways | 135/125 |
| 2003/0189044 | A1 * | 10/2003 | Kellogg et al. | 220/9.2 |
| 2004/0045779 | A1 * | 3/2004 | Chen | 190/37 |
| 2005/0034947 | A1 | 2/2005 | Nykoluk | |
| 2008/0006548 | A1 * | 1/2008 | Shiao | 206/315.3 |
| 2008/0261733 | A1 * | 10/2008 | Filippini | 473/540 |
| 2009/0046955 | A1 * | 2/2009 | Schember et al. | 383/33 |
| 2009/0114648 | A1 * | 5/2009 | Kellogg et al. | 220/9.3 |
| 2010/0176171 | A1 | 7/2010 | Araujo et al. | |

* cited by examiner

FOLDABLE EASY-ACCESS BAG

BACKGROUND OF THE INVENTION

1. Field of the Invention

Embodiments of the present invention relate to bags, and more particularly to a foldable utility bag. Embodiments of the present invention relate generally to soft sided utility bags and packs, and in particular to a soft sided bag with a structure forming a flexible frame system that can provide the soft sided bag with structural definition, integrity, and form, and in various embodiments may also allow the soft sided bag to be foldable.

2. Background and Related Art

Bags are useful for carrying items from one location to another. Bags of many types have been designed for carrying many different types of equipment. Some bags have soft sides to permit flexible storage of items therein. In some instances, placing items in soft sided bags can be difficult as the sides tend to collapse and may get in the way of placing items in the bags. Soft sided packs are generally made wholly with one or more pliable materials, which do not contribute significantly to giving the soft sided bag discernable form or structure. The structure-less nature of the soft sided bags does not provide adequate protection for stored items and can make loading and viewing of contents difficult.

Other bags have hard or stiff sides that can facilitate placing contents in the bags as the hard or stiff sides maintain open one or more inner cavities of the bags. Moreover, hard-sided bags provide greater protection to contents. However, when hard-sided bags are not in use, they are often difficult to store, as the hard sides dictate an increased storage space.

Structure forming frames for bags, packs, and other containers have conventionally been used to provide some measure of form. Structure forming frames are typically made of materials such as wood, nylon, nylon composites, steel, aluminum, spring steel, spring wires, fiberglass, fiberglass reinforced plastic, or plastic (most generally poly vinyl chloride (PVC)), or combinations thereof. For those applications where the frame must be bent or contorted, certain elasticity is required. Elasticity depends on the contents and formation of materials in the structure forming frame. However, creating a structure forming frame using continuous members that are bent or contorted in one portion, and straight in another, is difficult because the tension in one portion of the frame is so easily transferred from one frame member to another. Additionally, most structure forming frames cannot be collapsed.

Thus, existing bags do not provide ideal solutions for all users by providing adequate protection and easy access while also providing a collapsible form that is easy to store and uses continuous framing members that are both bent and straight.

BRIEF SUMMARY OF THE INVENTION

The application describes bags and more particularly a foldable utility bag with a structure forming frame. Embodiments of the foldable utility bag comprise a soft sided bag coupled with structure forming frame member(s) that when in its expanded configuration provides the bag body with a structure that aids in the use of and access to the interior of the bag. Also described are embodiments of structure forming frame members that provide varying levels of restorative force that aid in providing a desired resiliency to the bag body. Finally, various configurations and embodiments are described that allow the bag body and the structure forming frame to collapse to smaller configurations, allowing easier storage of the soft sided bag.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

Figure 1:
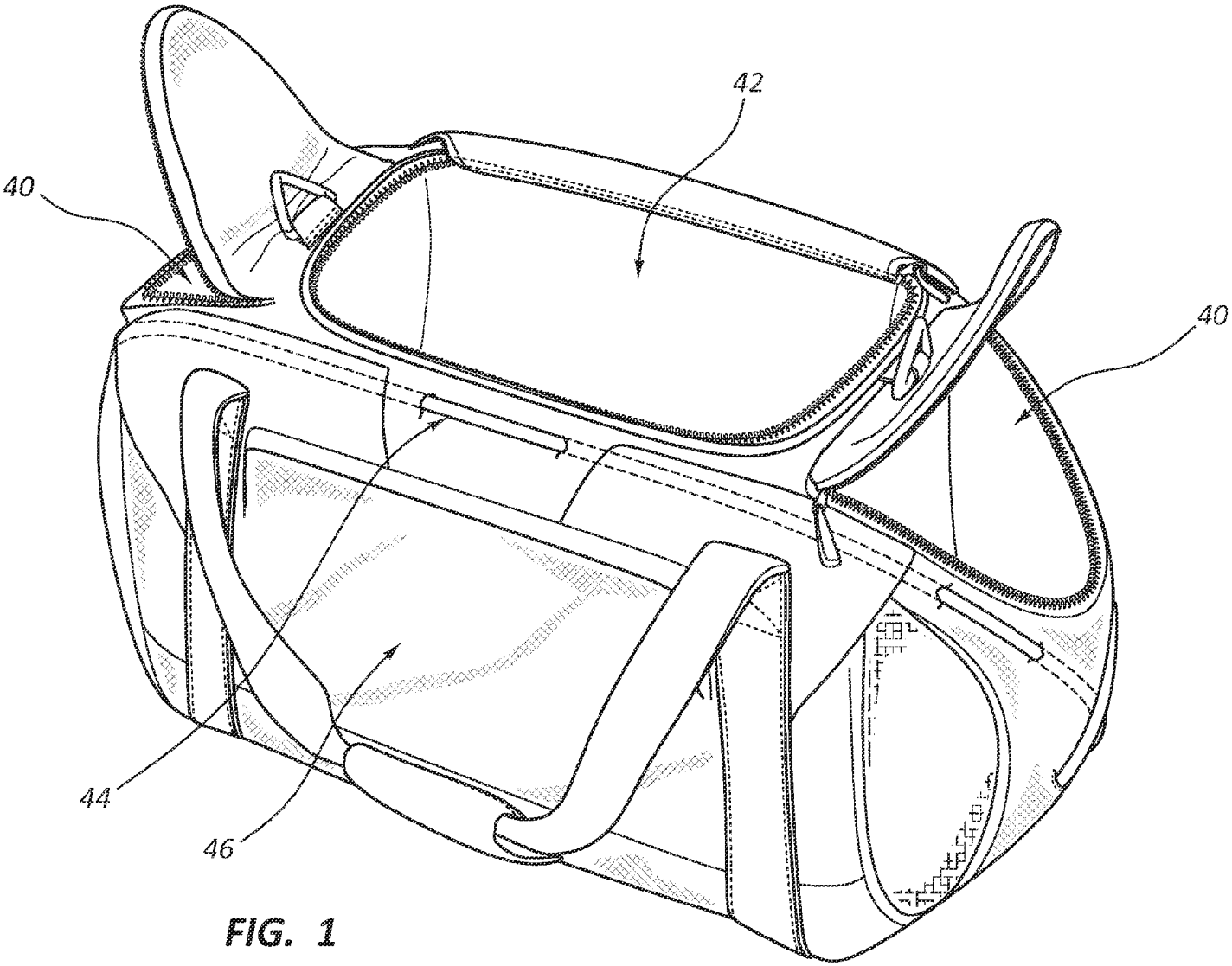
FIG. 1 illustrates the soft sided bag in accordance with various embodiments of the invention in the fully expanded configuration with its access ports open.

Together with the following description, the Figures may demonstrate and explain the principles of foldable utility bags. In the Figures, the thickness and configuration of components may be exaggerated for clarity. The same reference numerals in different drawings represent the same element, and thus their descriptions will not be repeated.

DETAILED DESCRIPTION OF THE INVENTION

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims and their equivalents. The following description supplies specific details in order to provide a thorough understanding. Nevertheless, the skilled artisan would understand that the foldable utility bag and methods for making or using the foldable utility bag can be implemented and used without employing these specific details. Indeed, the technology can be practiced by modifying the illustrated method and resulting product and can be used in conjunction with apparatus and techniques conventionally used in the industry.

The description may use perspective-based descriptions such as up/down, back/front, and top/bottom. Such descriptions are merely used to facilitate the discussion and are not intended to restrict the application of embodiments of the present invention.

For the purposes of the present invention, the phrase "A/B" means A or B. For the purposes of the present invention, the phrase "A and/or B" means "(A), (B), or (A and B)." For the purposes of the present invention, the phrase "at least one of A, B, and C" means "(A), (B), (C), (A and B), (A and C), (B and C), or (A, B and C)." For the purposes of the present invention, the phrase "(A)B" means "(B) or (AB)", that is, A is an optional element.

Various operations may be described as multiple discrete operations in turn, in a manner that may be helpful in understanding embodiments of the present invention; however, the order of description should not be construed to imply that these operations are order dependent.

The description may use the phrases "in an embodiment," or "in various embodiments," which may each refer to one or more of the same or different embodiments. Furthermore, the terms "comprising," "including," "having," and the like, as used with respect to embodiments of the present invention, are synonymous with the definition afforded the term "comprising."

The terms "coupled" and "connected," along with their derivatives, may be used. It should be understood that these terms are not intended as synonyms for each other. Rather, in particular embodiments, "connected" may be used to indicate that two or more elements are in direct physical or contact with each other. "Coupled" may mean that two or more elements are in direct physical or electrical contact. However, "coupled" may also mean that two or more elements are not in direct contact with each other, but yet still cooperate or interact with each other.

The term "soft sided bag" is defined generally as a bag that has at least one body portion that is at least partially constructed of a pliable material such as cloth, leather, synthetic leather, nylon, cordura, other fabrics or materials, or combinations thereof. It should be understood that the term "soft sided bag" does not indicate that every portion of the soft sided bag is constructed of a pliable material, rather that at least one portion of the soft sided bag is at least partially constructed of a pliable material. The term "strap" and/or "harness" is used generally to include one or more components of a system that is configured to allow a soft sided bag to be carried by the user. A "shoulder strap" is defined to include a strap having one or more straps that are adapted to engage one or both of the wearer's shoulders. A "handle" is defined to include one or more straps configured to allow a user to pick up the soft sided bag with their hand or similar grasping device. The term "bag bottom side" is defined to be the portion or side of the bag generally that rests on the ground. The term "bag top side" is defined to be the portion of the soft sided bag that generally faces away from the grounds when the soft sided bag is resting on the ground. Each side of the soft sided bag that connects the bag top side to the bag bottom side is defined to be a "bag lateral side." The term "bag end side" is defined to be the one or two bag lateral sides that have the smallest area.

In various embodiments a foldable utility bag is provided that includes a flexible frame system that may be integrated with a soft sided bag to help define the shape and structure of the bag body. Embodiments of a structure forming frame system may comprise one or more structure forming frame members made of a material that is flexible enough to allow the frame members to be bent and integrated into the bag, yet rigid and reflexive enough that when in place the frame members give the soft sided bag a desired shape or form.

In some embodiments, at least one structure forming frame member(s) may be integrated with the soft sided bag during manufacture. In other embodiments, the user may couple at least one structure forming frame member(s) to the soft sided bag via designated frame couplers or guides. In some embodiments, at least one frame member(s) may be wholly external, partially external or wholly internal to the soft sided bag material, depending on a variety of factors, including, but not limited to aesthetics, desired degree of protection, exposure to water and dirt, material specifications, desired configuration of the bag body, and the like. Further, the structure forming frame members may be partially exposed though the use of multiple guides, receivers or member couplers.

In various embodiments, the structure forming frame member may be a unitary, multi-structured, segmented, and/or continuous frame member having strength sufficient to maintain the shape of a soft sided bag. Structure forming frame members may be elastic, durable, light-weight, and possess excellent restoration force. In accordance with some embodiments, the structure forming frame member may include an outer sheath having a hollow portion or interior chamber inside which are disposed one or more inner rods. In some embodiments the structure forming frame member may consist of one or more inner rods that run the full length of the structure forming frame member with one or more shorter inner rods disposed strategically along the length of the structure forming frame member that provide differing levels of restoration force. Inner rods may be constructed of nylon, nylon composites, steel, aluminum, spring steel, spring wires, fiber glass, fiber glass reinforced plastic, plastic or fiber reinforced plastic, other materials, or combinations thereof, which are inserted into the hollow portion or embedded inside the structure forming frame member.

In various embodiments the structure forming frame members may also be of a sufficient rigidity to provide protection to the stowed cargo, and may also have a memory response such that upon deflection of the frame, it will reassume its expanded configuration and thereby reestablish the desired form. In some embodiments the structure forming frame members will be able to provide the structure to the bag body regardless of whether various access ports are open or closed, thereby providing structure to the bag to promote access to the interior.

In some embodiments, the structural support of the bag body may be collapsed to reduce the size of the bag body and facilitate its storage. In some embodiments, the structural support of the soft sided bag will easily fold in on itself to lie flat. In some embodiments, the bag body will automatically resume its fully expanded configuration when removed from storage. In some embodiments, additional user action is needed to allow the bag to resume its fully expanded configuration.

In some embodiments, at least one strap, handle, harness, or shoulder harness may be coupled to the soft sided bag body. In other embodiments the strap, handle, harness, or shoulder harness can be removed or relocated by the user. In some embodiments the strap, handle, harness, or shoulder harness will be attached to the soft sided bag at a fixed location. In other embodiments, the soft sided bag will not have any strap, handle, harness, or shoulder harness. In some embodiments the strap, handle, harness, or shoulder harness can provide the user with additional functions, such as also operating as an access port closure mechanism, a structure forming frame member, or assist in holding the soft sided bag in its collapsed form.

Figure 2:
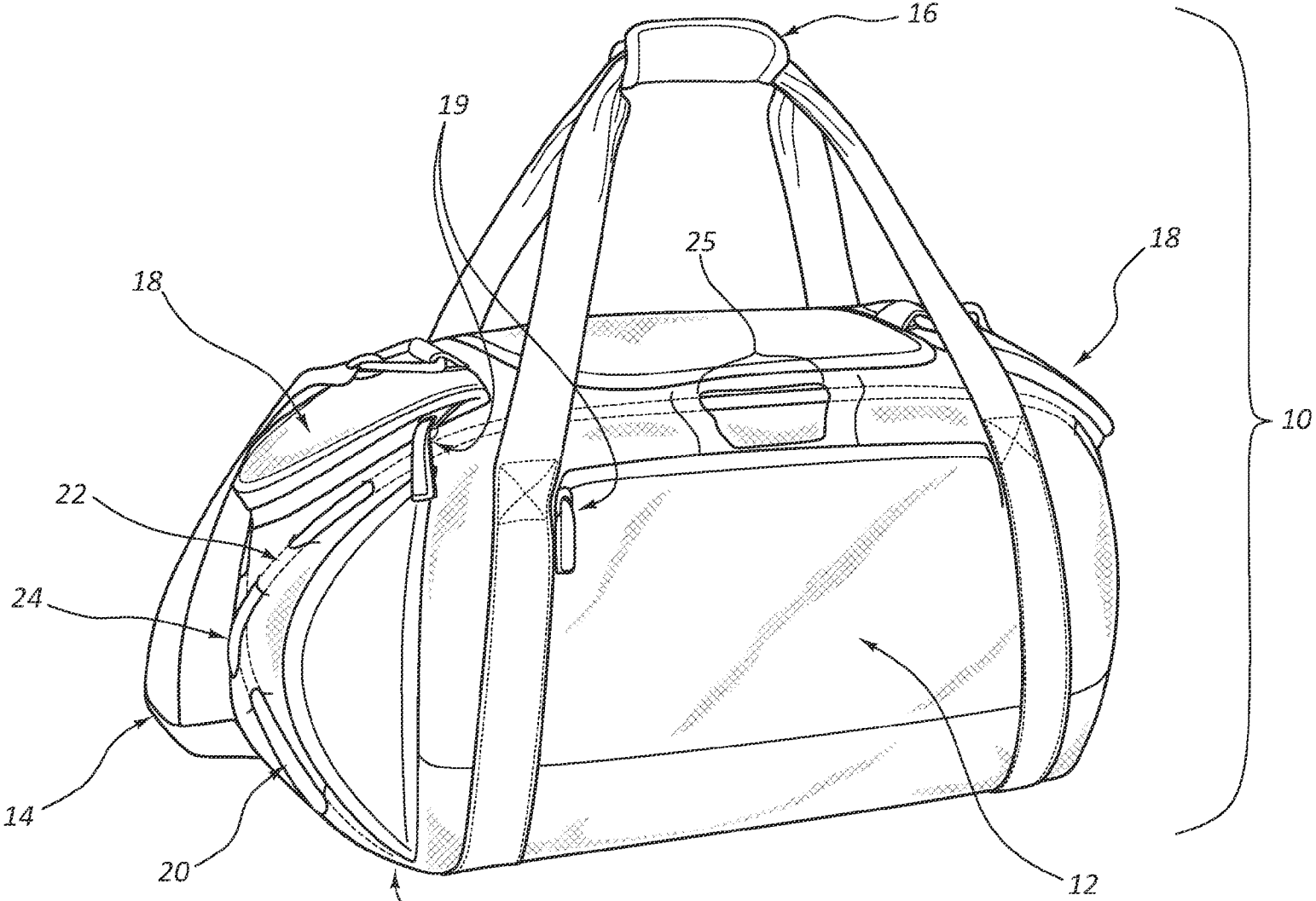
FIG. 2 illustrates the soft sided bag in accordance with various embodiments of the invention in the fully expanded configuration with its access ports closed.
Figure 3:
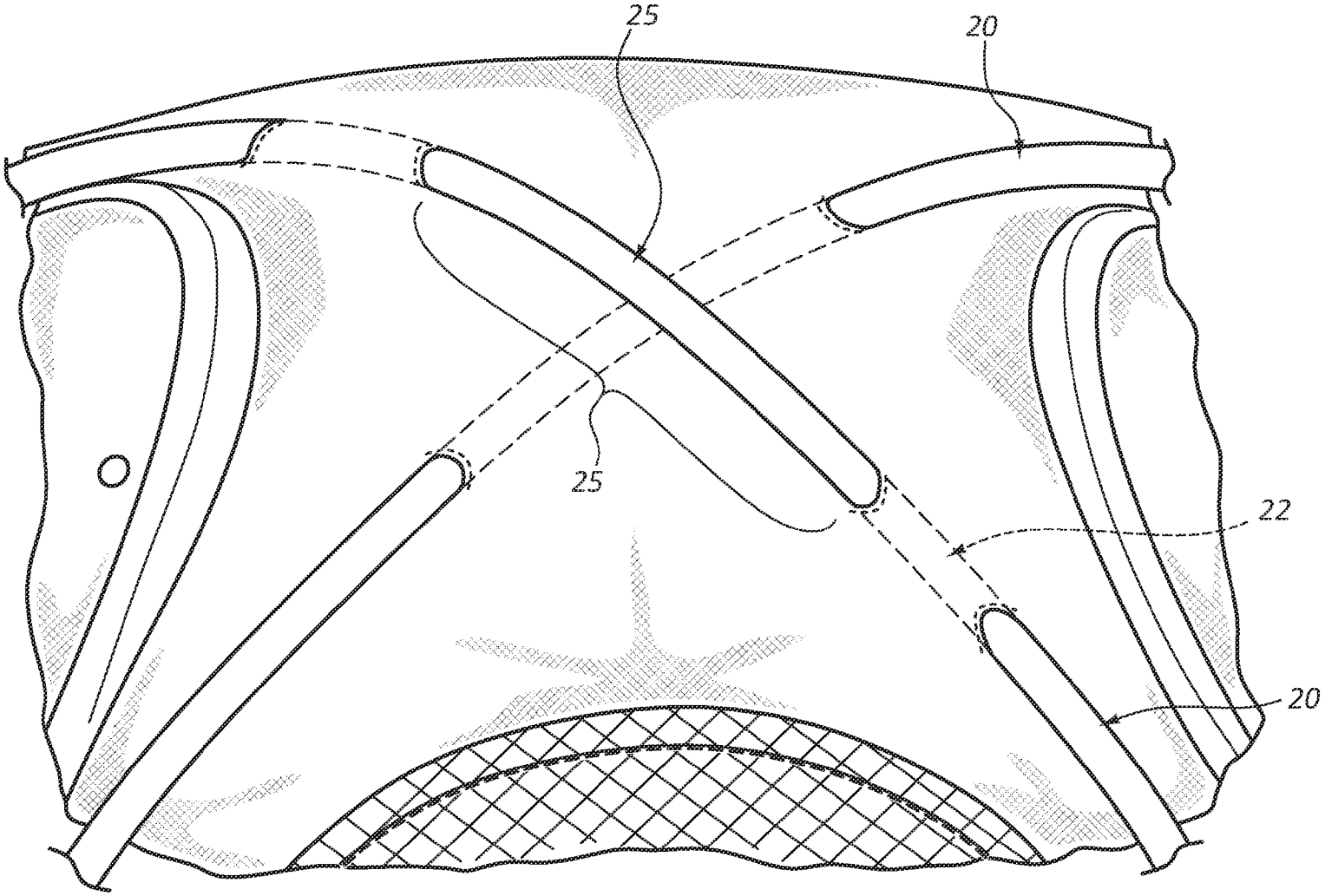
FIG. 3 illustrates a view of one of the bag lateral sides of the soft sided bag in accordance with various embodiments of the invention.
Figure 4C:
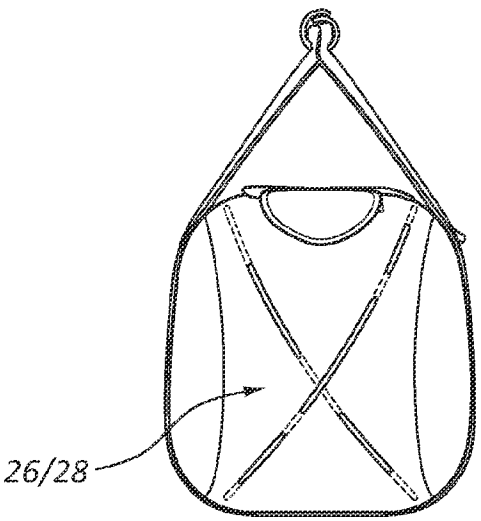
FIG. 4C illustrates a view of one of the bag end sides of the soft sided bag in accordance with various embodiments of the invention.
Figure 4A:
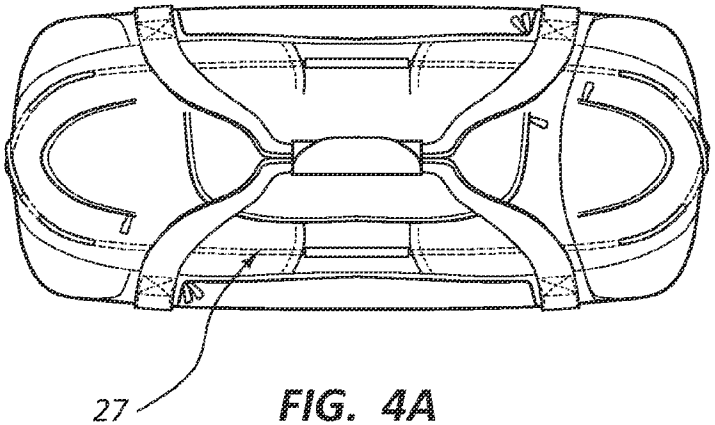
FIG. 4A illustrates a view of the bag top side of the soft sided bag in accordance with various embodiments of the invention.
Figure 4B:
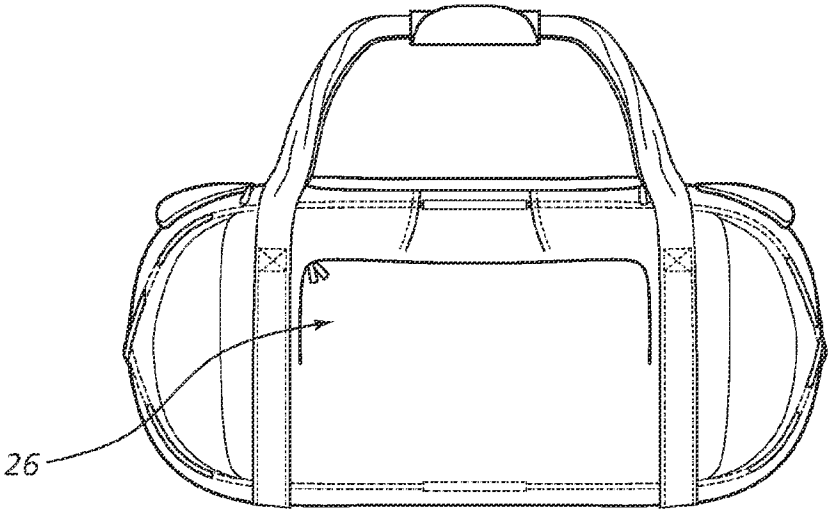
FIG. 4B illustrates a view of one of the bag lateral sides of the soft sided bag in accordance with various embodiments of the invention.

FIGS. 1 and 2 illustrate perspective views of an example soft sided bag having a structure forming flexible frame system. FIG. 3 illustrates a lateral side view of another example of a soft sided bag having a structure forming a flexible frame system . . . .

As illustrated in FIG. 2, a soft sided bag 10 may include a bag body 12, and several shoulder strap(s) 14 and/or a handle(s) 16 or other strap(s) or harness(es) coupled to the bag body 12. In various embodiments, a variety of other body coupling configurations or combinations may be used to allow a user to carry the bag (e.g. single shoulder strap, no shoulder straps, etc.). Bag body 12 may include several access ports 18, which allow access to pockets or internal compartments of the soft sided bag 10. Access ports 18 may be closeable via a variety of closure mechanisms 19 such as zippers, Velcro®, snaps, buttons and the like.

Soft sided bag 10 may further include one or more structure forming frame member(s) 20 that are adapted to engage the bag body 12 via one or more frame couplers or guides 22. In some embodiments, guides 22 may be loop guides, grommets, hooks or any other coupling/guide arrangement in which the structure forming frame member(s) 20 can engage to give the bag body 12 structural definition. As illustrated, tunnel guides 22, for example, may be sewn to the body material and have openings sized to allow the structure forming frame member 20 to pass there through. In some embodiments, the guides 22 may be internal or external to the body 12, and may further be adapted to encompass all or a part of the structure forming frame members 20. In various embodiments, the soft sided bag 10 may have several guides 22 engaging structure forming frame members 20.

With the structure forming frame members 20 inserted in the guides 22, the reflexive tension in the structure forming frame members 20 gives the bag body 12 a desired form and structure. Such a structure helps make loading the soft sided bag 10 easier, and/or provide structural support and protection of the contents of the bags. In some embodiments, one or more structure forming frame members 20 are used to provide a desired shape and accommodate different sizes and configurations. The structure forming frame members 20 may be integrated throughout the bag body 12 in a pattern generally defined by guides 22 and having terminal ends 21 that are configured to terminate against each other to thereby form a continuous loop. Whereas in other embodiments, the structure forming frame member 20 may engage the guides 22 and have opposing terminal ends 21 that terminate at designated receivers 23 disposed on the bag body 12. In other embodiments, one or more structure forming frame member 20 may be a continuous loop that has no terminal end 21. In other embodiments, one or more structure forming frame member 20 may have a terminal end 21 that does not terminate at designated receivers 23, but instead is coupled with other parts of the bag body 10, shoulder strap 14, handle 16, or any other part of the soft sided bag 12. It is contemplated that in some embodiments the structure forming frame member 20 may have a terminal end 21 that does not terminate at any designated receiver 23.

Some embodiments have frame members 20 cross in an "x" pattern at the ends of the bag. This allows the bag to be folded length wise so it flattens for storage. This "x" configuration also gives protection to the ends of the bags and more specifically to the contents of the bag stored in the ends. Because prior art bags do not have this rigid "x" to protect the ends of the bags, a pocket is usually placed on the ends so soft articles can be stored there to protect the inner contents of the bag or fragile items are at least kept away from the ends. In some embodiments, like that shown in FIG. 2, frame members 20 protect the ends thereby creating more usable space inside the bag. Items placed in a pocket on the ends or in the bag are protected.

In some embodiments, the guides 22 may be configurable by the user so as to alter the structural form taken by the bag body 12 once the structure forming frame members 20 engage the guides 22. In such cases, the guides 22 may be detachably coupled to the body of the bag or positioned on guide tracks to allow for guide repositioning.

In some embodiments, the structural rigidity and support of the bag body 12 may be enhanced by having the structure forming frame members 20 form one or more cross points 24. In some embodiments, cross points 24 may allow the bag body 12 to better resist lateral and vertical deflection caused by external and internal forces to the bag body 12. In addition to resisting structural collapse/deformation, including cross points 24 further helps enhance structural responsiveness of the structure forming frame members 20 to deflections. For example, the non-limiting case in which zero, one, two, three, four, five, six, seven, eight, nine, ten, eleven, twelve, thirteen, fourteen, fifteen, sixteen, seventeen, eighteen, nineteen, twenty, or more cross points 24 are formed by structure forming frame members 20 that help the soft sided bag 10 resist deflection.

In some embodiments, a portion of at least one of the structure forming frame members 20 may run tangentially to and/or circumnavigate all or a portion of an access port 18 in such a manner that undoing of the access port closure mechanism 19 may bias the access port 18 to either an open and/or closed position. In other embodiments, the soft sided bag 10 will maintain the desired form regardless of whether the various access ports 18 are open or closed.

FIGS. 1 and 2 illustrate perspective views of a soft sided bag in accordance with various embodiments. As illustrated, soft sided bag 10 may have a bag body 12 made of a generally pliable material, as described above. One or more structure forming frame members 20 may traverse portions of the bag body 12 to provide structural definition and integrity to the soft sided bag 10. Guides 22 may be strategically positioned about the bag body 12 of the soft sided bag 10 to allow for integration of the structure forming frame members 20 with the soft sided bag 10. As illustrated, portions of the structure forming frame members 20 may be exposed a desired amount, for example, by exposed lengths 25. Further, one or more cross points 24 may be included to improve structural integrity of the bag body 12. In one embodiment, it has been found that enclosing a portion of the structure forming frame member 20 within the bag body 12, and allowing other portions of the structure forming frame member 20 to be exposed by certain exposed lengths 25 provide enough desired structure to the bag body 12 but also create the desired shape to the bag body 12. It is contemplated that the structure forming frame member 20 can be can be placed in guides 22, grommets, openings, channels, rivets, or other attachment device or system that are attached to the bag body 12 to create various desired configurations of the bag, ranging anywhere from simple parallelepipeds, to cylindrical prisms, to ovaloids, to rhombitruncated icosidodecahedra, and more. In various embodiments, the use of structure forming frame members 20 will be arranged so as to hold portions of the bag body 12 in flat, vertical, rounded, or other orientations.

For purposes of discussion with respect to the illustrated embodiments, the bag body 12 may or may not be divided into multiple compartments. Such compartments may include one or more terminal compartments 40, central compartments 42, valuables compartments 44, accessory compartments 46, other types of compartments, or any combination thereof. It is contemplated that the bag body 12 can be divided into external and/or internal compartments and that various closure mechanisms 19 including zippers, buttons, Velcro, snaps, and the like can be used to close various compartments.

For example, the non-limiting case in which the soft sided bag 10 has zero, one, two, three, four, five, six, seven, eight, nine, ten, eleven, twelve, thirteen, fourteen, fifteen, sixteen, seventeen, eighteen, nineteen, twenty, or more terminal compartments 40, zero, one, two, three, four, five, six, seven, eight, nine, ten, eleven, twelve, thirteen, fourteen, fifteen, sixteen, seventeen, eighteen, nineteen, twenty, or more central compartments 42, zero, one, two, three, four, five, six, seven, eight, nine, ten, eleven, twelve, thirteen, fourteen, fifteen, sixteen, seventeen, eighteen, nineteen, twenty, or more valuables compartments 44, zero, one, two, three, four, five, six, seven, eight, nine, ten, eleven, twelve, thirteen, fourteen, fifteen, sixteen, seventeen, eighteen, nineteen, twenty, or more accessory compartments 46, and zero, one, two, three, four, five, six, seven, eight, nine, ten, eleven, twelve, thirteen, fourteen, fifteen, sixteen, seventeen, eighteen, nineteen, twenty, or more other types of compartments, and/or any combination thereof, closed by zero, one, two, three, four, five, six, seven, eight, nine, ten, eleven, twelve, thirteen, fourteen, fifteen, sixteen, seventeen, eighteen, nineteen, twenty, or more closure mechanisms 19.

A shoulder strap 14 may be coupled to soft sided bag 10. Shoulder strap 14 may include a padded shoulder harness. Soft sided bag 10 may also have a handle 16 coupled to soft sided bag 10 and adapted to generally allow a user to carry the bag. Other embodiments might include other forms of straps or harnesses attached at various points to the soft sided bag 10. Shoulder straps 14, handles 16, and other straps or harnesses may be integrated with the bag during manufacture. In other embodiments, the user may couple at least one structure forming frame member(s) to the bag via designated frame couplers or guides 22, or other attachment points. In various embodiments, the shoulder strap 14 or handle 16 or other carrying mechanism can be used to assist in holding the soft bodied bag 10 in a collapsed configuration.

In various embodiments, the structure forming frame member(s) 20 may be composed of a variety of materials, including but not limited to nylon, nylon composite, fiberglass, carbon fiber, steel wires, steel spring wires, combinations thereof, and/or other materials that are flexible enough to be bent or otherwise contorted throughout the guides 22 without breaking or kinking, and yet rigid enough to have a resulting tension that provides structural definition to the soft sided bag 10.

In some embodiments, the number of and/or diameter of the structure forming frame member 20 may be selected depending on many factors such as intended use, aesthetics, durability, etc. In some embodiments, the structure forming frame member 20 may be unitary, consisting of only one material. In other embodiments, such as the non-limiting examples illustrated in FIGS. 5A, 5B, 6A 6B, 6C, and 6D, the structure forming frame member 20 may be multi-part. In various embodiments the structure forming frame member 20 may be multi-piece or dual structured. For example, in some embodiments, the structure forming frame member 20 may include zero, one, two, three, four, five, six, seven, eight, nine, ten, eleven, twelve, thirteen, fourteen, fifteen, sixteen, seventeen, eighteen, nineteen, twenty, or more inner rods, such as inner rod 55, which are wholly or partially enclosed by zero, one, two, three, four, five, six, seven, eight, nine, ten, eleven, twelve, thirteen, fourteen, fifteen, sixteen, seventeen, eighteen, nineteen, twenty, or more non-hollow sheath(s) 33. In other embodiments, a structure forming frame member 20 may include zero, one, two, three, four, five, six, seven, eight, nine, ten, eleven, twelve, thirteen, fourteen, fifteen, sixteen, seventeen, eighteen, nineteen, twenty, or more outer sheath(s) 32 with a hollow core(s) 34, and zero, one, two, three, four, five, six, seven, eight, nine, ten, eleven, twelve, thirteen, fourteen, fifteen, sixteen, seventeen, eighteen, nineteen, twenty, or more inner rod(s) 35 may be inserted therein. Such a mixing of composite materials can help improve the degree of bend radii, while also providing sufficient structural rigidity, form, and shape resilience.

Figure 5B:
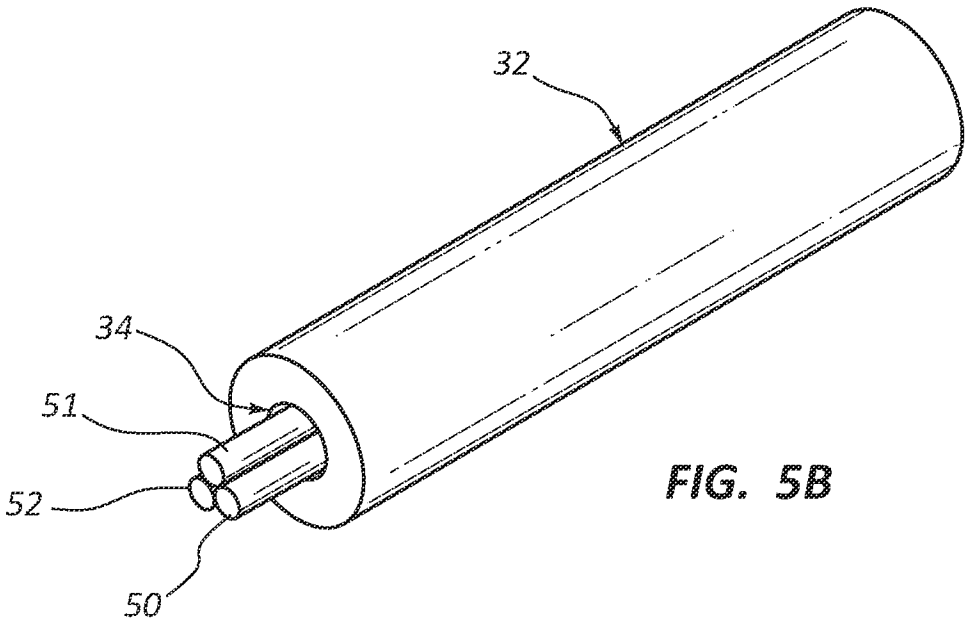
FIG. 5B illustrates a perspective view of a structure forming frame member in accordance with various embodiments of the invention.
Figure 5A:
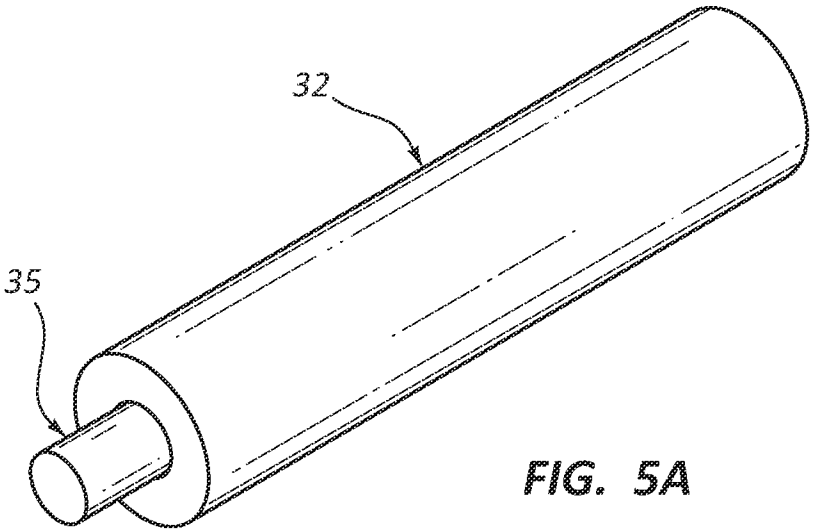
FIG. 5A illustrates a perspective view of a structure forming frame member in accordance with various embodiments of the invention.
Figure 6B:
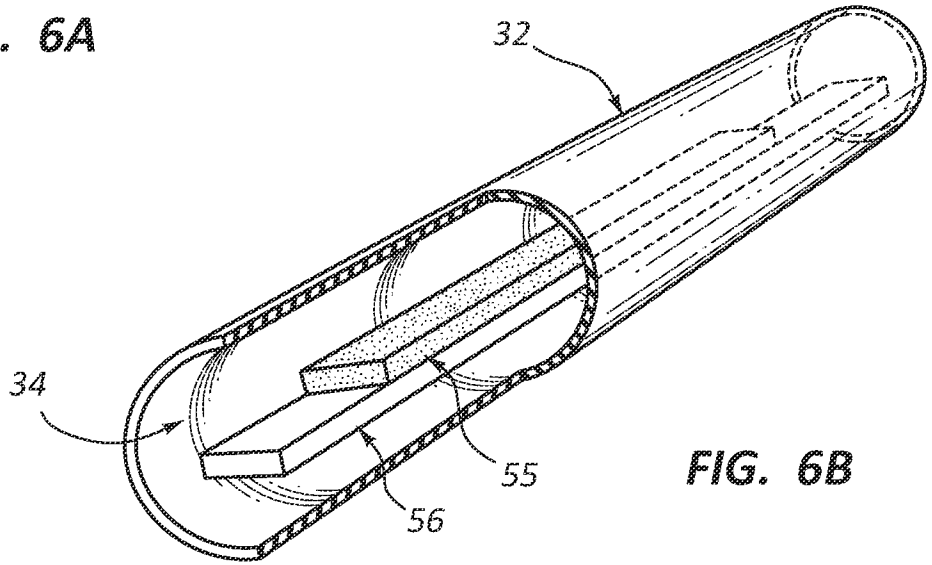
FIG. 6B illustrates a perspective view of a portion of a multi-part structure forming frame member with a cutout section showing the interior of an outer sheath with a hollow portion in accordance with various embodiments of the invention.
Figure 6A:
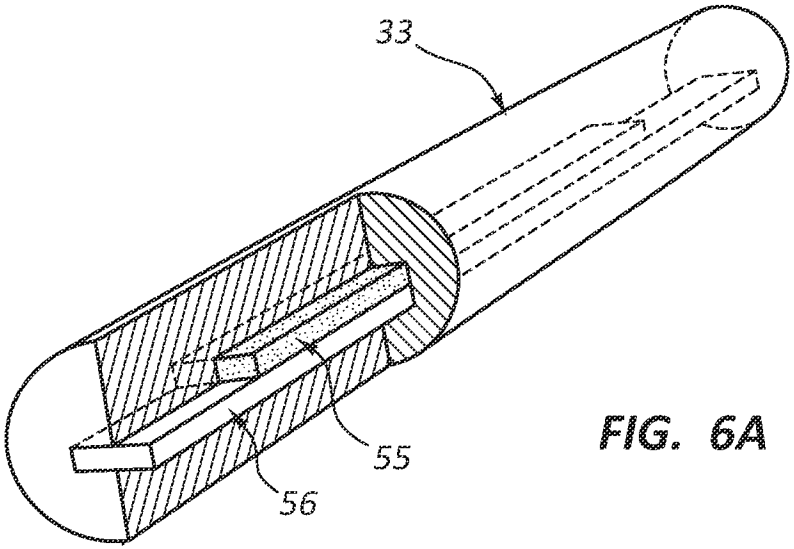
FIG. 6A illustrates a perspective view of a portion of a multi-part structure forming frame member with a cutout section showing the interior of a non-hollow sheath in accordance with various embodiments of the invention.
Figure 6C:
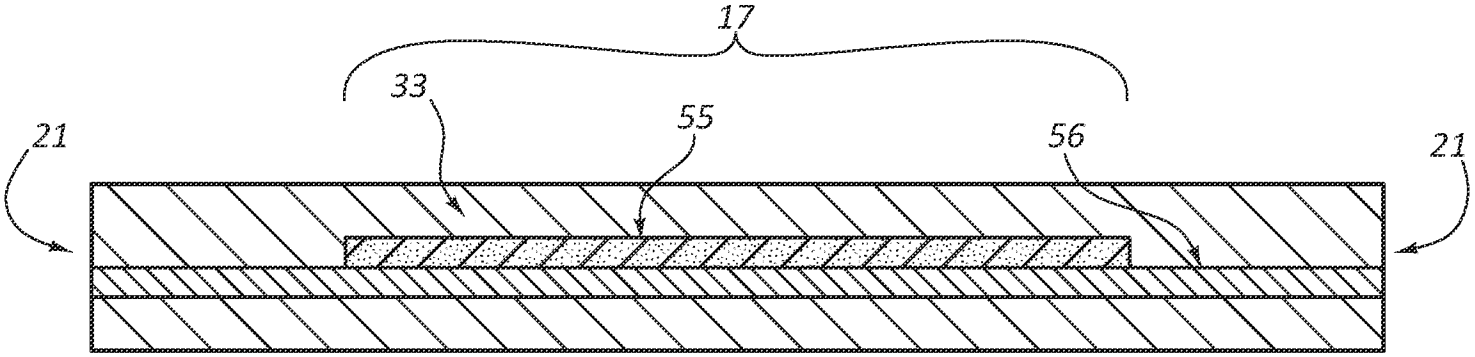
FIG. 6C illustrates a latitudinal section of a portion of a multi-part structure forming frame member with a non-hollow sheath in accordance with various embodiments of the invention.
Figure 6D:
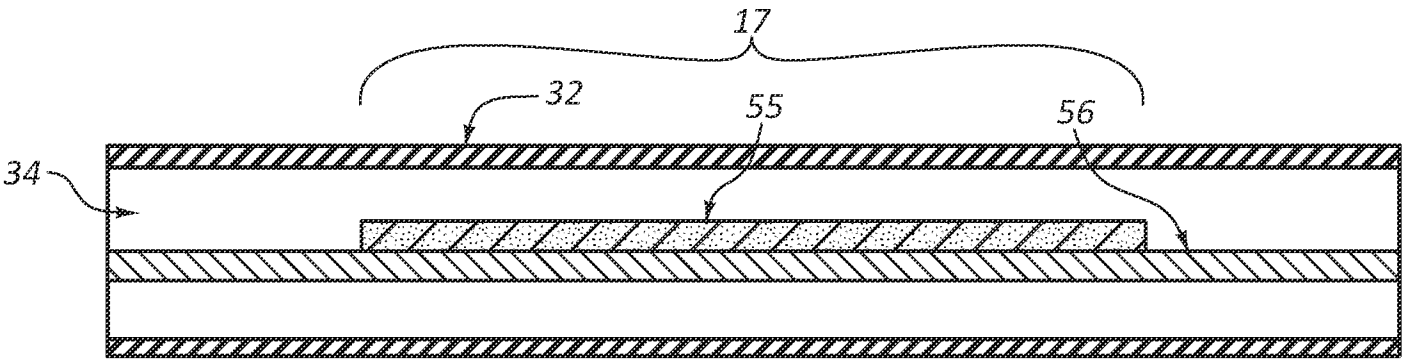
FIG. 6D illustrates a latitudinal section of a portion of a multi-part structure forming frame member with an outer sheath with a hollow portion in accordance with various embodiments of the invention.

For example, as illustrated in FIGS. 5A and 5B, according to some embodiments a structure forming frame member 20 may consist of zero, one, two, three, four, five, six, seven, eight, nine, ten, eleven, twelve, thirteen, fourteen, fifteen, sixteen, seventeen, eighteen, nineteen, twenty, or more inner rod(s) 35 and zero, one, two, three, four, five, six, seven, eight, nine, ten, eleven, twelve, thirteen, fourteen, fifteen, sixteen, seventeen, eighteen, nineteen, twenty, or more non-hollow sheath(s) 33. In other embodiments, as illustrated in FIG. 5, according to some embodiments a structure forming frame member 20 may include zero, one, two, three, four, five, six, seven, eight, nine, ten, eleven, twelve, thirteen, fourteen, fifteen, sixteen, seventeen, eighteen, nineteen, twenty, or more outer sheath(s) 32 having zero, one, two, three, four, five, six, seven, eight, nine, ten, eleven, twelve, thirteen, fourteen, fifteen, sixteen, seventeen, eighteen, nineteen, twenty, or more hollow portion(s) 34 or other interior chamber. In some embodiments, zero, one, two, three, four, five, six, seven, eight, nine, ten, eleven, twelve, thirteen, fourteen, fifteen, sixteen, seventeen, eighteen, nineteen, twenty, or more inner rod(s) 50, 51, 52, or more, may be disposed internal to the zero, one, two, three, four, five, six, seven, eight, nine, ten, eleven, twelve, thirteen, fourteen, fifteen, sixteen, seventeen, eighteen, nineteen, twenty, or more outer sheath(s) 32. In other embodiments, the zero, one, two, three, four, five, six, seven, eight, nine, ten, eleven, twelve, thirteen, fourteen, fifteen, sixteen, seventeen, eighteen, nineteen, twenty, or more inner rod(s) 50, 51, 52, or more, may be embedded in the wall of the outer sheath(s) 32.

FIGS. 5A, 5B, 6A 6B, 6C, and 6D illustrate non-limiting examples of multi-structured structure forming frame members 20 in accordance with various embodiments. Structure forming frame member(s) 20 may include an outer sheath 32 and at least one inner rod 35. In some embodiments, the outer sheath 32 may be made of synthetic material and the inner rod 35 made of nylon, nylon composites, steel, aluminum, spring steel, spring wires, fiber glass, fiber glass reinforced plastic, plastic or fiber reinforced plastic, or combinations thereof. The outer sheath 32 may be shaped to include a hollow portion 34 to accommodate one or more inner rod 35, which may improve its elasticity and strength. In other embodiments the structure forming frame member may consist of a non-hollow sheath 34 with an inner rod 35 embedded within. In other embodiments there may be zero, one, two, three, four, five, six, seven, eight, nine, ten, eleven, twelve, thirteen, fourteen, fifteen, sixteen, seventeen, eighteen, nineteen, twenty, or more inner rod(s) 35, 50, 51, 52, and/or outer sheath(s) 32, and/or non-hollow sheath(s) 33.

In some embodiments, the outer sheath 32 may be made of synthetic material selected from the group consisting of nylon, polyurethane, polycarbonate, polyethylene, polypropylene, or others. In some embodiments, the outer sheath 32 may be made through an extrusion molding or other conventional methods used to form high-molecular resin. An outer sheath 32 made of the above-mentioned high-molecular resins is advantageous in terms of cold resistance, durability, resistance to exposure to the elements, etc. In some embodiments, nylon may be a preferable material for forming the outer sheath 32 because of its ability to resistant to breakage resulting from an external impact, scratches, and severe bending, and as well as its toughness and low temperature performance. In some embodiments, a color pigment may be added to the outer sheath 32. In various embodiments, a minimum amount of color pigment may be used to make a transparent outer sheath 32 so that the inner rod, which is inserted into the outer sheath 32, can be seen from outside. Alternatively, various colors of pigment may be added to manufacture an outer sheath 32 having distinctive visual characteristics. The same description holds not only when the outer sheath 32 is made of a nylon composition, but also when other materials (e.g. polyurethane, polyethylene, polypropylene, polycarbonate, etc.) are used. Other embodiments contemplate similar aspects of material, manufacture, additives, and more for non-hollow sheaths 33 or other portions of the structure forming frame members 20.

Some embodiments contemplate making an outer sheath 32 or a non-hollow sheath 33 out of fiber-reinforced composition glass, nylon, nylon composites, steel, aluminum, spring steel, spring wires, fiber glass, fiber glass reinforced plastic, plastic or fiber reinforced plastic, or combinations thereof, or other material. Other embodiments contemplate manufacturing an outer sheath 32 or a non-hollow sheath 33 that are reinforced by embedding fiber-reinforced composition glass, nylon, nylon composites, steel, aluminum, spring steel, spring wires, fiber glass, fiber glass reinforced plastic, plastic or fiber reinforced plastic, or combinations thereof, or other material used to manufacture the outer sheath 32 or a non-hollow sheath 33 so as to prevent degradation of strength, elasticity, restoration force, etc. of the outer sheath 32 or a non-hollow sheath 33.

As mentioned above, in some embodiments, the structure forming frame member 20 can be unitary, consisting of only one part, such as a nylon rod. Other embodiments contemplate zero, one, two, three, four, five, six, seven, eight, nine, ten, eleven, twelve, thirteen, fourteen, fifteen, sixteen, seventeen, eighteen, nineteen, twenty, or more inner rods and/or sheaths, as illustrated in FIGS. 6A, 6B, 6C, and 6D. In one embodiment, it has been found that using at least one inner rod, such as inner rod 50, made of steel spring encased in an outer sheath 32 with hollow portion 34 created enough tension and strength to provide structural definition to the bag body 12. In other embodiments, it has been found that multiple inner rods 55 and 56 of differing lengths placed strategically along the length of either a non-hollow sheath 33 or an outer sheath 32 with hollow portion 34 allow a pleasing curve at the bag end side of the bag 28 and relatively straight segments along the length of the bag 30. In one embodiment the shorter inner rod 55 is placed in the medial portion 17 of the outer sheath 32, such that the structure forming frame member 20 is more resistant to external forces in its medial portion 17.

Other embodiments contemplate the use of more than just one or two inner rods, such as inner rods 55 and 56, disposed at other positions along the structure forming frame member 20 to create differing levels of restoration force. Some embodiments contemplate utilizing and/or manipulating the number and/or diameter and/or length of inner rods such as 55 and 56 along the length of the structure forming frame member 20 to create various shapes. In a non-limiting example, the terminal portions of the support members 21 may be composed of one or more inner rods 35, 50, 51, 52, 55, and 56 or other types of inner rod allowing for the terminal end 21 of the structure forming frame member 20 to possess flexibility to allow for additional or decreased curvature at desired locations. In some embodiments the medial portion 17 of the structure forming frame member 20 may utilize two or more inner rods 35, 50, 51, 52, and 56, or other types of inner rod, doubling, tripling, quadrupling or multiplicatively increasing the number of wires along the portion of the inner rod passing along the bag top side 27, effectively providing for a structure forming frame member which possess increased or decreased flexibility along the length of the structure forming frame member 20, such that along the structure forming frame member 20 portions are selectively stiffer and therefore more likely to tend to assume a more linear configuration, which may provide the appropriate balance of flexibility and rigidity. For example, the non-limiting case in which zero, one, two, three, four, five, six, seven, eight, nine, ten, eleven, twelve, thirteen, fourteen, fifteen, sixteen, seventeen, eighteen, nineteen, twenty, or more inner rods 35, 50, 51, 52, and/or 56, and or other types of inner rods are used inside the outer sheath(s) 32.

In other embodiments, one continuous inner rod 35 may be bent back or folded back zero, one, two, three, four, five, six, seven, eight, nine, ten, eleven, twelve, thirteen, fourteen, fifteen, sixteen, seventeen, eighteen, nineteen, twenty, or more times upon itself in selected portions to increase or decrease the structure forming frame member's 20 resistance to external forces. In other embodiments, any combination of inner rods 35, 50, 51, 52, 55, and 56 or other types of inner rod may be bent, folded, woven, twisted, stretched, or otherwise manipulated along any portion of the length of the structure forming frame member 20 to increase or decrease its resistance to external or internal forces. For example, the non-limiting case in which a combination of zero, one, two, three, four, five, six, seven, eight, nine, ten, eleven, twelve, thirteen, fourteen, fifteen, sixteen, seventeen, eighteen, nineteen, twenty, or more inner rods 35, 50, 51, 52, 55, and 56 are bent, folded, woven, twisted, stretched, or otherwise manipulated along discrete portions to increase or decrease the structure forming frame member's 20 resistance to external or internal forces.

In some embodiments, inner rods 35, 50, 51, 52, 55, and 56 or other types of inner rod may be constructed of nylon, nylon composites, steel, aluminum, spring steel, spring wires, fiber glass, fiber glass reinforced plastic, plastic or fiber reinforced plastic, or combinations thereof. In other embodiments the material for the inner rod may be a single component of carbon fiber, aramid fiber, fiberglass, titanium, a mixture of the component with another resin, nylon, nylon composites, steel, aluminum, spring steel, spring wires, fiber glass, fiber glass reinforced plastic, plastic or fiber reinforced plastic, or combinations thereof, or other materials that achieve the desired effect.

As mentioned in the non-limiting examples above, using a multi-structured structure forming frame member 20 has many advantages which include elasticity, strength, and durability, and light-weight, ability to regain its original shape. Moreover, in some embodiments, using a multi-component structure forming frame member 20 protects the user and the soft-sided bag 10 from being harmed in the unlikely event that any inner rods such as inner rod 35 break because the outer sheath 32 or non-hollow sheath 33 prevents the sharp edges from being exposed to the outside.

Various embodiments may also employ additives, such as a reinforcement material, a filler, a heat-resistant stabilizer, a weatherproof stabilizer, a slip agent, a nucleating agent, a fire retardant, color pigment, dye, etc. Examples of additives include talc, carbon fiber, calcium carbonate, clay, silica, alumina, carbon black, magnesium hydroxide, zeolite, barium sulfate, etc.

In some embodiments the inner rods 35, 50, 51, 52, 55, 56, or other inner rods, may be cylindrical, rectangular, or may take other forms. In some embodiments the outer sheath 32 and the non-hollow sheath 33 may be cylindrical, rectangular, or may take other forms. In other embodiments, other shapes and configurations of the inner rods 35, 50, 51, 52, 55, 56, other inner rods, outer sheath 32, and non-hollow sheath 33 are contemplated. In some embodiments the inner rods 35, 50, 51, 52, 55, 56, or other inner rods may be connected, stacked, attached, woven, banded, glued, embedded, or otherwise attached or unattached to other inner rods 35, 50, 51, 52, 55, 56, or other inner rods, or to the outer sheath 32 or non-hollow sheath 33, or other portion of the structure forming frame member 20.

Likewise, in some embodiments portions of a structure forming frame member 20, or outer sheath 32, or non-hollow sheath 33 may be connected, attached, woven, banded, glued, embedded, or otherwise attached or unattached to other portions of the structure forming frame member(s) 20 or to the bag body 12. In some embodiments, inner rods 35, 50, 51, 52, 55, 56, or other inner rods, may be fully or partially coated in plastic, Teflon®, lubricant, grease, or other friction-inducing or friction-reducing agent or material to allow more or less movement in relation to the other components of the structure forming frame member 20. In some embodiments, the use of such friction inducing or reducing agents or materials will be to increase or decrease the structure forming frame members' 20 resistance to external forces and create differing levels of restoration force. In some embodiments, the inner rods 35, 50, 51, 52, 55, 56, or other inner rods, may be fully or partially coated in a protective material such a plastic, nylon, or other material that decreases the likelihood that any sharp edges or breaks on the inner rods 35, 50, 51, 52, 55, 56, or other inner rods harm the outer sheath 23 or non-hollow sheath 33.

While a relatively rectangular shaped soft sided bag 10 is depicted in FIGS. 1-3, other embodiments contemplate substantially different dimensions. In a non-limiting example, similar to those illustrated in FIGS. 6A, 6B, 6C, and 6D, steel spring wires may be utilized for one of the constitutive elements of a structure forming frame member 20 flexible enough to allow structure forming frame member 20 to be bent and integrated into the soft sided bag 10, yet rigid and flexible enough that when in place the structure forming frame member(s) 20 give the bag body 12 the desired shape and form. In such a non-limiting example, the steel spring wires are elastic, durable, possess excellent restoration force and are light weight.

Figure 7B:
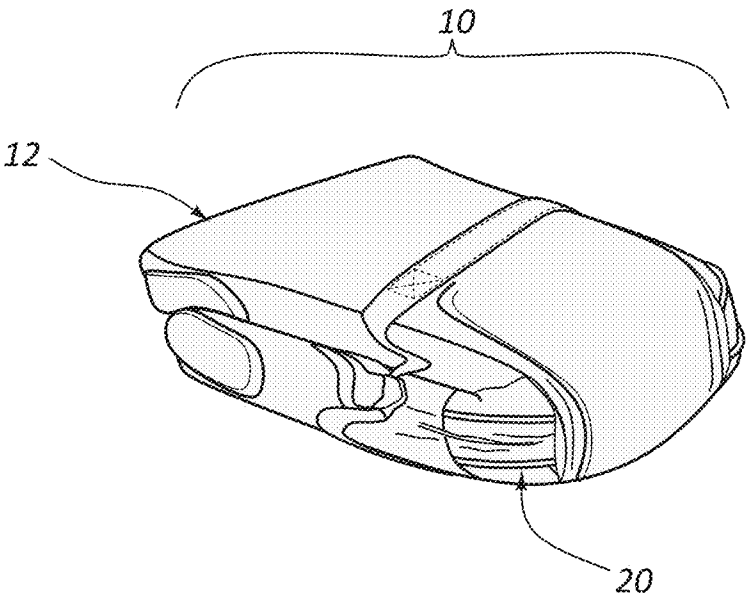
FIG. 7B illustrates a perspective view of a soft sided bag in its collapsed form in accordance with various embodiments.
Figure 7A:
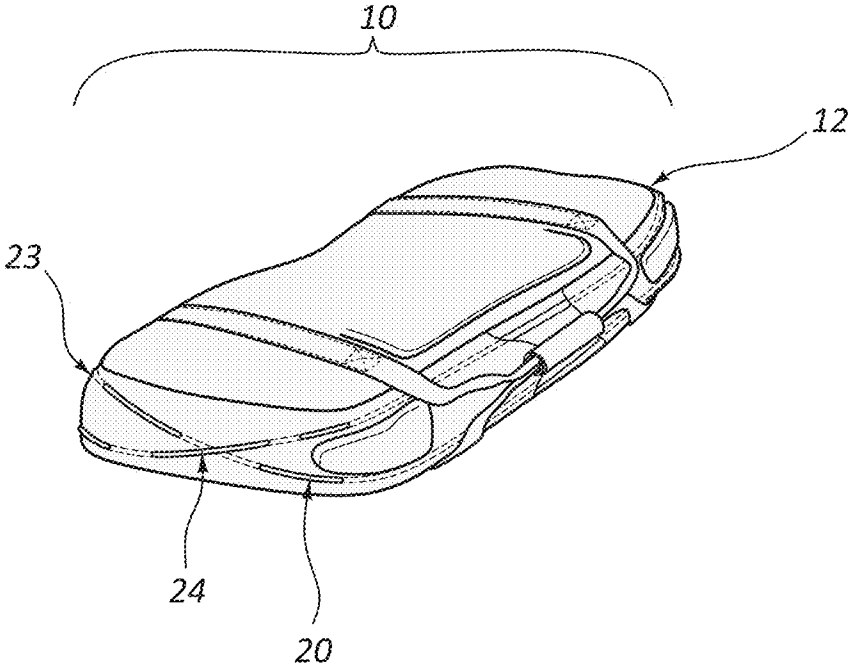
FIG. 7A illustrates a perspective view of a soft sided bag in its collapsed form in accordance with various embodiments.

FIGS. 7A and 7B illustrate how, in some embodiments, the soft sided bag 10 can be collapsed to reduce its size. In some embodiments, zero, one, two, three, four, five, six, seven, eight, nine, ten, eleven, twelve, thirteen, fourteen, fifteen, sixteen, seventeen, eighteen, nineteen, twenty, or more structure forming frame member(s) 20 can be pushed, pulled, moved, rotated, or otherwise manipulated to a new position that results in a less-voluminous configuration. In other embodiments, such as the one illustrated in FIG. 7A, structure forming frame member(s) 20 can be pressed upon from the bag lateral side 26 to collapse them into one parallel plane, reducing the soft sided bag 10 into a flattened configuration. Other configurations of zero, one, two, three, four, five, six, seven, eight, nine, ten, eleven, twelve, thirteen, fourteen, fifteen, sixteen, seventeen, eighteen, nineteen, twenty, or more structure forming frame members 20 are contemplated that include hinged, rotating, removable, expandable, retractable, or other moving parts that assist in the collapsibility of the soft sided bag 10. In other embodiments, the soft sided bag 10 will remain in its collapsed configuration only when stored in a position that applies continuous pressure on some portion of the soft sided bag 10. In some embodiments, the structure forming frame member(s) 20 can be twisted or moved in such a way as to collapse the soft sided bag 10, which will then remain in the collapsed form without any additional pressure, locking, twisting, or other force. In various embodiments, the soft sided bag 10 will automatically resume its fully expanded configuration with or without user action. Whereas in other embodiments, the user will need to perform at least one action to allow the soft sided bag 10 to resume its expanded configuration. It is contemplated in various embodiments that hooks, zippers, Velcro, snaps, buttons, straps, handles, and the like may be used to press, lock, twist, or otherwise force the soft sided bag 10 to remain it is collapsed configuration.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A bag comprising:

a first structure forming frame member having a length and comprising:

an outer sheath made of a first material, extending the length of the first structure forming frame member, and having an aperture disposed therein having an inner diameter;

a plurality of inner rods made of a second material having an outer diameter concentrically disposed within the inner diameter of the sheath aperture, wherein a number of inner rods within the outer sheath varies along the length of the first structure forming frame member;

the first structure forming frame member having a variable flexibility along the length thereof;

a second structure forming frame member having a length and comprising:

an outer sheath made of a first material, extending the length of the second structure forming frame member, and having an aperture disposed therein having an inner diameter;

a plurality of inner rods made of a second material having an outer diameter concentrically disposed within the inner diameter of the sheath aperture, wherein a number of inner rods within the outer sheath varies along the length of the second structure forming frame member;

the second structure forming frame member having a variable flexibility along the length thereof; and a guide disposed about a bag body and sized to connect with the first structure forming frame member, wherein the first structure forming frame member engages the guide to provide the bag with a desired structural form, wherein the first structure forming frame member and the second structure forming frame member cross at an end of the bag, and wherein the first structure forming frame member and the second structure forming frame member may be manipulated to allow the bag to collapse into a less-voluminous configuration.

2. The bag of claim 1, further comprising a plurality of guides.

3. The bag of claim 1, wherein the bag body is made at least in part of a generally pliable material.

4. The bag of claim 3, further comprising bag bottom side and a bag top side joined by bag lateral sides and said end, defining and enclosing an interior cavity.

5. The bag of claim 4, wherein the bag body comprises a durable material that is sufficiently flexible to allow the bag to be substantially collapsed to minimize a volume of the bag for storage.

6. The bag of claim 1, wherein the first structure-forming frame member and the second structure-forming frame member have lengths of increased flexibility proximate the end of the bag where the first structure forming frame member and the second structure forming frame member cross.

7. The bag of claim 1, further comprising an access port providing access to a compartment.

8. The bag of claim 1, wherein said first and second structure forming frame members may be manipulated to allow the bag to collapse to a less-voluminous configuration.

9. The bag of claim 1, further comprising the use of more than one inner rod along a segment of the length of each structure forming frame member to create various shapes.

10. The bag of claim 9, wherein a terminal portion of each structure forming frame member comprises a smaller number of inner rods than a medial portion thereof to allow the terminal portion of each structure forming frame member to possess increased flexibility to allow for additional curvature at desired locations.

11. The bag of claim 10, the medial portion of each structure forming frame member being structured to pass along a bag top side, wherein the medial portion of the structure forming frame member comprises the use of more than one inner rod, effectively providing for a structure forming frame member which possess decreased flexibility along the length of the medial portion of the structure forming frame member.

12. The bag of claim 1, wherein at least a portion of each structure forming frame member tracks the pattern of an access port, wherein each structure forming frame member portion is capable of biasing the access port into a position selected from the group consisting of an open and a closed position.

13. The bag of claim 1, wherein each structure forming frame member is configured to include one or more endless loops.

14. A soft sided bag comprising:

a bag body made at least in part of a generally pliable material, comprising a bag bottom, and a bag top side joined by bag lateral sides, defining and enclosing an interior cavity, wherein the bag body comprises a durable material that is sufficiently flexible to allow the soft sided bag to be substantially collapsed to minimize a volume of the soft sided bag for storage;

a structure forming frame member having a length and comprising an outer sheath extending the length of the structure forming frame member, the structure forming frame member having a variable flexibility along the length thereof, wherein a limited segment of the structure forming frame member comprises a selected number of inner rods to allow the limited segment of the structure forming frame member to possess one of increased flexibility and decreased flexibility to allow for one of additional curvature and decreased curvature at desired locations; and a plurality of guides disposed about the bag body and sized to connect with at least a portion of the structure forming frame member, wherein the structure forming frame member engages the plurality of guides, thereby providing the bag with a desired structural form, wherein the structure forming frame member may be manipulated to allow the soft sided bag to collapse into a less-voluminous configuration.

15. The soft sided bag of claim 14, wherein a plurality of structure forming frame members are disposed about the bag body, sized to engage with the plurality of guides, connect to some number of said guides, and wherein one or more structure forming frame members may be manipulated to allow the soft sided bag to collapse to a less-voluminous configuration.

16. The soft sided bag of claim 14, wherein the outer sheath has a first outer diameter and is made of a first material, the outer sheath having an aperture disposed therein having an inner diameter; and one or more inner rods made of a second material having a second outer diameter that is less than the inner diameter of the outer sheath aperture.

17. The soft sided bag of claim 14, wherein the structure forming frame member comprises a segment that generally tracks the pattern of access port, wherein the structure forming frame is structured to bias the access port in one of an open and closed position.

18. The soft sided bag of claim 14, further comprising the use of more than one inner rods along a segment of the length of the structure forming frame member to create various shapes.

19. The soft sided bag of claim 14, comprising a limited segment of the structure forming frame member, wherein the limited segment of the structure forming frame member comprises the use of more than one inner rod, effectively providing for a structure forming frame member which possess decreased flexibility along the length of the limited segment of the structure forming frame member.

20. The soft sided bag of claim 14, wherein the sheath is made of a first material and has an aperture disposed therein having an inner diameter, and wherein the structure forming frame member comprises at least one inner rod made of a second material having a second outer diameter concentrically disposed within the inner diameter of the sheath aperture.

21. The soft sided bag of claim 20, further comprising a number of inner rods selected from the group consisting of two inner rods, three inner rods, four inner rods, five inner rods, six inner rods, seven inner rods, eight inner rods and nine inner rods.

22. The soft sided bag of claim 20, further comprising the use of more than one inner rod along a segment of the length of the structure forming frame member to create various shapes.

23. The soft sided bag of claim 20, wherein a terminal portion of the structure forming frame member comprises a smaller number of inner rods than a medial portion thereof to allow the terminal end of the structure forming frame member to possess increased flexibility to allow for additional curvature at desired locations.

24. The soft sided bag of claim 23, the medial portion of the structure forming frame member being structured to pass along the bag top side, wherein the medial portion of the structure forming frame member comprises the use of more than one inner rod, effectively providing for a structure forming frame member which possess decreased flexibility along the length of the medial portion of the structure.

25. A structure forming frame member having a variable flexibility along a length thereof for structure forming applications, comprising:

an outer sheath extending substantially an entire length of the structure forming frame member; and a plurality of inner rods disposed in the outer sheath, wherein a first length of the structure forming frame member has fewer inner rods disposed therein than a second length of the structure forming frame member, such that the first length has increased flexibility compared to the second length, and wherein a limited segment of the structure forming frame member comprises a selected number of inner rods to allow the limited segment of the structure forming frame member to possess one of increased flexibility and decreased flexibility to allow for one of additional curvature and decreased curvature at desired locations.

26. The structure forming frame member of claim 25, wherein one or more inner rods are contained within a non-hollow outer sheath.

27. The structure forming frame member of claim 25, wherein one or more inner rods are inserted into a hollow portion of an outer sheath.

28. The structure forming frame member of claim 25, further comprising a number of inner rods selected from the group consisting of two inner rods, three inner rods, four inner rods, five inner rods, six inner rods, seven inner rods, eight inner rods and nine inner rods.

29. The structure forming frame member of claim 25, further comprising the use of more than one inner rod along a segment of the length of the structure forming frame member to create various shapes.

30. The structure forming frame member of claim 25, wherein a first inner rod of the plurality of inner rods extends unbroken substantially the entire length of the structure forming frame member, and wherein a second inner rod of the plurality of inner rods extends alongside the first inner rod and within the sheath a length less than the entire length of the structure forming frame member.

* * * * *